United States Patent [19]

Miller et al.

[11] Patent Number: 4,573,063

[45] Date of Patent: Feb. 25, 1986

[54] RECORD MEMBER

[75] Inventors: Robert E. Miller; Steven L. Vervacke, both of Appleton, Wis.

[73] Assignee: Appleton Papers Inc., Appleton, Wis.

[21] Appl. No.: 612,956

[22] Filed: May 23, 1984

[51] Int. Cl.[4] ..... B41M 5/16; B41M 5/22

[52] U.S. Cl. ..... 346/216; 346/225; 427/150

[58] Field of Search ..... 346/216, 217, 225; 427/150, 151, 152

[56] References Cited

U.S. PATENT DOCUMENTS 2,811,564 10/1957 Bader ..... 528/98

4,165,103 8/1979 Bodmer ..... 428/327

*Primary Examiner*—Bruce H. Hess

*Attorney, Agent, or Firm*—E. Frank McKinney; Paul S. Phillips, Jr.

[57] ABSTRACT

A record member comprising a developer composition comprising an addition product of a phenol and a diolefinic alkylated or alkenylated cyclic hydrocarbon is disclosed. These addition products are particularly useful as color developers for basic chromogenic material.

12 Claims, No Drawings

RECORD MEMBER

This invention relates to the production of novel record material. More specifically, the invention involves sensitized record sheet material useful in developing dark-colored marks on contact with colorless solutions of basic chromogenic material (also called color formers). Such sheet material includes color developer material generally in the form of a coating on at least one sheet surface. The coating of color developer material serves as a receiving surface for colorless, liquid solutions of color formers which react, on contact, with the color developer material to produce the dark-colored marks.

Pressure-sensitive carbonless copy paper of the transfer type consists of multiple cooperating superimposed plies in the form of sheets of paper which have coated, on one surface of one such ply, pressure-rupturable microcapsules containing a solution of one or more color formers (hereinafter referred to as a CB sheet) for transfer to a second ply carrying a coating comprising one or more color developers (hereinafter referred to as a CF sheet). To the uncoated side of the CF sheet can also be applied pressure-rupturable microcapsules containing a solution of color formers resulting in a pressure-sensitive sheet which is coated on both the front and back sides (hereinafter referred to as a CFB sheet). When said plies are superimposed, one on the other, in such manner that the microcapsules of one ply are in proximity with the color developers of the second ply, the application of pressure, as by typewriter, sufficient to rupture the microcapsules, releases the solution of color former and transfers color former solution to the CF sheet resulting in image formation through reaction of the color former with the color developer. Such transfer systems and their preparation are disclosed in U.S. Pat. No. 2,730,456.

The use of certain biphenols as color developers in pressure-sensitive carbonless copy paper is disclosed in U.S. Pat. No. 3,244,550. U.S. Pat. No. 4,076,887 discloses a recording sheet comprising a developer consisting of a dimer of an alkenyl phenol.

Although certain biphenol compounds have been suggested for use as color developers in pressure-sensitive carbonless copy paper, the compounds suggested have failed to overcome certain existing problems in carbonless copy paper or have proven to have defects of their own which make them unattractive as color developers in commercial carbonless copy paper systems. The greatest single problem of many of the biphenol color developers previously suggested has been their failure to provide an adequately intense image under conditions of use in carbonless copy paper systems. The second greatest defect of these suggested biphenol developers has been that, even if they were utilized in carbonless copy paper systems in such a manner that an adequately intense image was obtained initially, this ability to continue to provide an adequately intense print was seriously reduced merely upon the natural aging of the coated sheet (hereinafter referred to as CF decline).

Among the existing problems in carbonless copy systems which the previously-suggested biphenol developers have failed to overcome are fade, decline and speed of image formation.

It is therefore an object of the present invention to provide a record member having improved image intensity, both initially and upon aging.

Another object of the present invention is to provide a record member having improved speed of image formation.

Still another object of the present invention is to provide a record member having improved resistance to fade and/or decline.

Yet another object of the present invention is to provide a record member comprising a substrate and a developer composition comprising an addition product of a phenol and a diolefinic alkylated or alkenylated cyclic hydrocarbon.

In accordance with the present invention, it has been found that these and other objectives may be attained by employing a CF sheet which comprises a substrate coated with a composition comprising one or more addition products of phenol and a diolefinic alkylated or alkenylated cyclic hydrocarbon characterized by a hydroxyl unit greater than about 120–140.

The developer composition comprising an eligible addition product of phenol and a diolefinic alkylated or alkenylated cyclic hydrocarbon can be utilized in either a transfer carbonless copy paper system as disclosed hereinbefore or in a self-contained carbonless copy paper system such as disclosed in U.S. Pat. Nos. 2,730,457 and 4,167,346. Many of both types of carbonless copy paper systems are exemplified in U.S. Pat. No. 3,672,935. Of the many possible arrangements of the mark-forming components in the transfer type of carbonless copy paper system, the most commonly employed is the one wherein the developer composition includes the color developer, one or more mineral materials and one or more binders. These compositions are then applied in the form of a wet slurry to the surface of what becomes the underlying ply (the CF sheet) in the carbonless copy paper system. Such CF sheet color developer composition coatings are disclosed in U.S. Pat. Nos. 3,455,721; 3,732,120; 4,166,644; and 4,188,456. Another useful arrangement of the developer composition is to prepare a sensitizing solution of the developer material and apply the solution to the nap fibers of sheet paper as disclosed in U.S. Pat. No. 3,466,184. A suitable alternative is to apply such a sensitizing solution of developer material to a base-coated sheet wherein the base coating comprises a pigment material. Examples of such pigment material include calcium carbonate, kaolin clay, calcined kaolin clay, etc. and mixtures thereof.

Examples of eligible color formers for use with the color developers of the present invention, to develop dark colored marks on contact, include, but are not limited to, Crystal Violet Lactone [3,3-bis(4-dimethylaminophenyl)-6-dimethylaminophthalide (U.S. Pat. No. Re. 23,024)]; phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 7-(1-ethyl-2-methylindol-3-yl)-7-(4-diethylamino-2-ethoxyphenyl)-5,7-dihydrofuro[3,4-b]pyridin-5-one (U.S. Pat. No.

4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spiro-di[2H-1-benzopyran]; and mixtures of any two or more of the above.

Preferred among the addition products of phenol and a diolefinic alkylated or alkenylated cyclic hydrocarbon of the present invention are those in which the cyclic hydrocarbon is selected from the group consisting of dipentene, menthadienes, mixtures of menthadienes, diisopropenylbenzene, divinylbenzene and 4-vinyl-1-cyclohexene. More preferred among said addition products are those in which the cyclic hydrocarbon selected from the group consisting of $\gamma$-terpinene, limonene and dipentene.

A method of preparing terpene phenolic compounds by the reaction of a phenolic compound with a cyclic terpene in the presence of polyphosphoric acid is disclosed in U.S. Pat. No. 2,811,564.

The following examples are given merely as illustrative of the present invention and are not to be considered as limiting. All percentages and parts throughout the application are by weight unless otherwise specified.

EXAMPLE 1

Preparation of phenol-limonene Addition Product

A 500 gram portion of phenol was dissolved in toluene and cooled to a temperature of less than 5° C. Gaseous nitrogen was bubbled through the phenol solution by means of a gas dispersion tube and a 30 cc. portion of redistilled $BF_3.(Et)_2O$ was added. The solution changed color from light yellow to light red-brown. A 140 gram portion of d-limonene was slowly added by a dropping funnel while the solution was maintained at a temperature of less than 5° C. After maintaining this temperature overnight to allow completion of the reacion, the mixture was neutralized with 0.2N sodium hydroxide solution. The progress of the neutralization was followed by means of a color change (dark to light) of the reaction mixture. The reaction mixture was then steam distilled to remove the unreacted phenol. The mixture was cooled to room temperature, some of the water was removed by decantation and the remainder was removed by azetropic distillation using diethylether. The excess solvent was allowed to evaporate and the product was dried in an oven at 135° C. for 64 hours, yielding 236 grams of product (94% yield after correction for purity of the limonene).

In procedures substantially like that of Example 1, addition products of phenol and the respective diolefinic hydrocarbon listed in Table 1 were prepared. The only substantial variation from the procedure of Example 1, was, in some of the instances as catalyst Amberlyst 15 (a sulfonated polystyrene-divinylbenzene copolymer cation exchange resin, made by Rohm & Haas Co., Philadelphia, PA) or sulfuric acid was used in place of $BF_3.(Et)_2O$.

TABLE 1

| Example | Olefin | Catalyst | Yield %* |
|---|---|---|---|
| 1 | limonene | $BF_3.(ET)_2O$ | 94% |

TABLE 1-continued

| Example | Olefin | Catalyst | Yield %* |
|---|---|---|---|
| 2 | limonene | $BF_3.(Et)_2O$ | 97% |
| 3 | limonene | $BF_3.(Et)_2O$ | 94% |
| 4 | $\alpha$-terpinene | $BF_3.(Et)_2O$ | 55% |
| 5 | divinylbenzene | $BF_3.(Et)_2O$ | 88% |
| 6 | m-diisopropenylbenzene | $BF_3.(Et)_2O$ | 66% |
| 7 | p-diisopropenylbenzene | Amberlyst 15 | 34% |
| 8 | p-diisopropenylbenzene | $BF_3.(Et)_2O$ | 42% |
| 9 | m-diisopropenylbenzene | Amberlyst 15 | 62% |
| 10 | 4-vinyl-1-cyclohexene | sulfuric acid | ** |

*corrected for purity of olefin
** not measured

The addition products of Table 1, along with eight additional phenol/diolefinic cyclic hydrocarbon addition products, were analyzed for hydroxyl content by the following procedure.

When addition products of phenol and a diolefinic alkylated or alkenylated cyclic hydrocarbon are subjected to Fourier transform infrared (FTIR) spectroscopy, a quantitative determination of the hydroxyl content can be obtained from the infrared spectra. In such a procedure, the infrared spectra of low concentration solutions of the addition products are recorded in absorbance units, which are proportional to concentration. The area under the curve at the absorption peak, $\pm 50$–$60$ $cm^{-1}$, of non-hydrogen bonded hydroxyl groups is measured. This resulting measurement, termed hydroxyl unit, shows a good correlation with the performance of these same addition products as color developers in carbonless copy paper systems. The hydroxyl unit herein defined has no direct relationship, either in measurement method or values reported, to the A.S.T.M. hydroxyl number and should not be confused with or related to same. Those addition products having hydroxyl units greater than about 120–140 perform well as color developers. Those addition products having hydroxyl units below this range perform poorly as color developers.

Each of the addition products analyzed for hydroxyl content supra were individually formulated into CF sheets by dissolving 0.1 gram of the addition product in 10 ml. of acetone, dropping ½ ml. of the resulting solution on filter paper and air drying the paper. The resulting CF sheets were tested in a Typewriter Intensity (TI) test with CB sheets comprising a coating of the composition listed in Table 2 applied as an 18% solids dispersion to a paper base using a No. 12 wire-wound coating rod.

TABLE 2

| Material | % Dry |
|---|---|
| Microcapsules | 74.1% |
| Corn Starch Binder | 7.4% |
| Wheat Starch Particles | 18.5% |

The microcapsules employed contained the color former solution of Table 3 within capsule walls comprising synthetic resins produced by polymerization methods utilizing initial condensates as taught in U.S. Pat. No. 4,100,103.

TABLE 3

| Material | Parts |
|---|---|
| 7-(1-ethyl-2-methylindol-3-yl)-7-(4-diethylamino-2-ethoxy-phenyl)-5,7-dihydrofuro[3,4-b] pyridin-5-one | 1.70 |
| $C_{10}$–$C_{13}$ alkylbenzene | 78.64 |

TABLE 3-continued

| Material | Parts |
|---|---|
| sec-butylbiphenyl | 19.60 |

In the TI test a standard pattern is typed on a coated side-to-coated side CB-CF pair. After the image develops overnight, the intensity is measured and reported as color difference.

The Hunter Tristimulus Colorimeter was used in these Examples to measure color difference, a quantitative representation of the ease of visual differentiation between the colors of two specimens. The Hunter Tristimulus Colorimeter is a direct-reading L, a, b instrument. L, a, b is a surface color scale (in which L represents lightness, a represents redness-greenness and b represents yellowness-blueness) and is related to the CIE tristimulus values, X, Y and Z, as follows:

$$L = 10Y^{\frac{1}{2}}$$

$$a = \frac{17.5\,[(X/0.98041) - Y]}{Y^{\frac{1}{2}}}$$

$$b = \frac{7.0\,[Y - (Z/1.18103)]}{Y^{\frac{1}{2}}}$$

The magnitude of total color difference is represented by a single number ΔE and is related to L, a, b values as follows:

$$\Delta E = [(\Delta L)^2 + (\Delta a)^2 + (\Delta b)^2]^{\frac{1}{2}}$$
$$\text{where } \Delta L = L_1 - L_o$$
$$\Delta a = a_1 - a_o$$
$$\Delta b = b_1 - b_o$$

$L_1$, $a_1$, $b_1$=object for which color difference is to be determined.

$L_o$, $a_o$, $b_o$=reference standard.

The above-described color scales and color difference measurements are described fully in Hunter, R. S. "The Measurement of Appearance", John Wiley & Sons, New York, 1975.

In table 4 are listed Examples 1–18, the corresponding olefin from which each addition product was made, the corresponding hydroxyl unit obtained for each addition product and the color difference obtained for the image on each CF sheet for each addition product.

For this particular configuration of carbonless copy paper a ΔE greater than about 18–20 is required for an acceptably intense image. As can be seen in Table 4, Examples 6, 8, 12 and 14–18 failed to produce prints of acceptable intensity. Likewise, all of these same eight samples possessed hydroxyl units less than 120–140. Hydroxyl unit correlates very well with color difference measurement of images and provides a suitable selection method for predicting the efficacy of phenol-olefin addition products as color developers. Addition products of phenol and a diolefinic alkylated or alkenylated cyclic hydrocarbon having hydroxyl units greater than about 120–140 perform very well as color developers. Such addition products below this range perform poorly as color developers.

TABLE 4

| Example | Olefin | Hydroxyl Unit | ΔE |
|---|---|---|---|
| 1 | limonene | 245 | 23.9 |
| 2 | limonene | 251 | 23.3 |
| 3 | limonene | 306 | 24.9<br>26.7[d] |
| 4 | α-terpinene | 258 | 25.4 |
| 5 | divinylbenzene | 249 | 25.0 |

TABLE 4-continued

| Example | Olefin | Hydroxyl Unit | ΔE |
|---|---|---|---|
| 6 | m-diisopropenylbenzene | 52 | 12.4 |
| 7 | p-diisopropenylbenzene | 227 | 23.4 |
| 8 | p-diisopropenylbenzene | 67 | 5.2 |
| 9 | m-diisopropenylbenzene | 212 | 23.8<br>25.6[d] |
| 10 | 4-vinyl-1-cyclohexene | 220 | 22.5 |
| 11 | terpene | 178 | 21.6<br>22.4[d] |
| 12 | terpene | 36 | 3.2 |
| 13 | terpene | 160 | 24.1<br>23.6[d] |
| 14 | terpene | 109 | 16.9<br>15.1[d] |
| 15 | terpene | 57 | 8.2 |
| 16 | terpene | 14 | 13.0 |
| 17 | terpene | 98 | 13.7<br>13.6[d] |
| 18 | terpene | 14 | 1.0 |

The invention being thus described, it will be obvious that the same may be varied in many ways. Such variations are not to be regarded as a departure from the spirit and scope of the invention, and all such modifications are intended to be included within the scope of the following claims.

What is claimed is:

1. A record member comprising a substrate and a developer composition comprising an addition product of phenol and a diolefinic alkylated or alkenylated cyclic hydrocarbon, said addition product being characterized by a hydroxyl unit greater than about 120–140.

2. The record member of claim 1 wherein the cyclic hydrocarbon is selected from the group consisting of dipentene, menthadienes, mixtures of menthadienes, diisopropenylbenzene, divinyl benzene and 4-vinyl-1-cyclohexene.

3. The record member of claim 2 wherein the menthadiene is terpinene or limonene.

4. The record member of claim 3 wherein the menthadiene is limonene.

5. The record member of claim 3 wherein the menthadiene is γ-terpinene.

6. The record member of claim 2 wherein the cyclic hydrocarbon is divinylbenzene.

7. A pressure-sensitive record unit comprising:

(a) support sheet material;

(b) mark-forming components, and a pressure-releasable liquid organic solvent for both said mark-forming components arranged in contiguous juxtaposition and supported by said sheet material;

(c) at least one of the mark-forming components being maintained in isolation from other mark-forming component(s);

(d) said mark-forming components comprising at least one basic chromogenic material and at least one addition product of phenol and a diolefinic alkylated or alkenylated cyclic hydrocarbon, said addition product being characterized by a hydroxyl unit greater than about 120–140, which components, on pressure release of the liquid organic solvent, are brought into reactive contact.

8. The record unit of claim 7 wherein the cyclic hydrocarbon is selected from the group consisting of dipentene, menthadienes, mixtures of menthadienes, diisopropenylbenzene, divinyl benzene and 4-vinyl-1-cyclohexene.

9. The record unit of claim 8 wherein the menthadiene is terpinene or limonene.

10. The record unit of claim 9 wherein the menthadiene is limonene.

11. The record unit of claim 9 wherein the menthadiene is γ-terpinene.

12. The record unit of claim 8 wherein the cyclic hydrocarbon is divinyl benzene.

* * * * *